US005348411A

United States Patent [19]

Ozu et al.

[11] Patent Number: 5,348,411

[45] Date of Patent: Sep. 20, 1994

[54] WRITING IMPLEMENT AND A FABRICATING METHOD THEREOF

[75] Inventors: Tatsuya Ozu, Kadoma; Masahiro Yasunaga, Osaka; Shigeyasu Inoue, Kashiwara, all of Japan

[73] Assignee: Kabushiki Kaisha Sakura Kurepasu, Osaka, Japan

[21] Appl. No.: 189,839

[22] Filed: Feb. 1, 1994

[30] Foreign Application Priority Data

Feb. 16, 1993 [JP] Japan ..... 5-4752[U]
Feb. 16, 1993 [JP] Japan ..... 5-26834
Feb. 16, 1993 [JP] Japan ..... 5-26835

[51] Int. Cl.[5] ..... B43K 7/10; B43K 8/04; B43K 5/18

[52] U.S. Cl. ..... 401/219; 401/205; 401/209; 401/236

[58] Field of Search ..... 401/219, 209, 205, 236

[56] References Cited

FOREIGN PATENT DOCUMENTS 971021 1/1951 France ..... 401/209
47-5661 2/1972 Japan ..... 401/219
2078175 1/1982 United Kingdom ..... 401/219

*Primary Examiner*—Steven A. Bratlie
*Attorney, Agent, or Firm*—Fish & Richardson

[57] ABSTRACT

A writing implement includes a valve device provided at a specified position along a liquid passage along which liquid to be applied flows. The valve device has a ball valve member, a chamber portion in which the ball valve member is placed, the chamber portion having a cross-section in the form of a non-circular substantially circumscribing the ball valve member, a sealing portion operable to come to contact with the ball valve member entirely along a circumference of the ball valve member to interrupt the flow of liquid, and a restricting portion operable to come to contact with a circumferential portion of the ball valve member to restrict the movement of the ball valve member toward a leading end of the writing implement.

11 Claims, 8 Drawing Sheets

WRITING IMPLEMENT AND A FABRICATING METHOD THEREOF

BACKGROUND OF THE INVENTION

The present invention relates to a writing implement having a ball valve in a casing thereof so as to prevent a back flow of liquid to be applied and also to a fabricating method thereof.

Some of the conventional writing implements are provided with a mechanism for preventing ink (liquid to be applied) contained therein from flowing backward to bottom end thereof when a nib thereof is turned upward.

For example, Japanese Examined Utility Model Publication No. 4-52067 discloses a ball-point pen having therein projections extending axially and spaced apart radially and a ball seat formed more toward the bottom end than the projections. In this manner, a valve chamber is formed between the bearing and the projections and a ball valve member is accommodated loosely movably in the valve chamber. In this type of writing implements, if the nib is turned downward during the writing, the ball valve member comes to contact with the projections, thereby being preventing from moving toward a leading end and the ink flows to the nib through passages formed between the projections. If the nib is turned upward when the writing implement is not used for the writing, the ball valve member rests on the bearing to stop the ink flow, thereby preventing the back flow of ink toward the bottom end.

The writing implements described above meet with the following problems to be solved.

A) In a state where the nib is turned downward, i.e., where the ball valve member is engaged with the projections, it is necessary to cause a sufficient amount of ink to flow toward the nib through the passages between the ball valve member and the casing. Accordingly, the inside diameter of the valve chamber needs to be sufficiently greater than the outside diameter of the ball valve member. This allows the ball valve member to move freely in the valve chamber not only axially, but also radially. Because of this unnecessary movement, it takes a long time for the ball valve member to rest on the bearing when the nib is turned suddenly upward from a state where it faces downward and hence it is difficult to prevent the back flow of ink immediately. Further, in a state where the nib is turned not right upward, but obliquely upward, the ball valve member may not rest on the bearing exactly, thereby causing the back flow of ink to be prevented unsatisfactorily.

B) Since the movement of the ball valve member is stopped by the axially extending projections, a total contact area of the ball valve member with the projections is small. Thus, there is a demand for a structure capable of preventing more reliably the ball valve member from moving out of the valve chamber. If the contact area of the ball valve member with the projections is increased, i.e., the projections are made larger in the aforementioned structure, the ink passages formed between the projections are narrowed, thereby making it difficult to supply a sufficient amount of ink to the nib.

SUMMARY OF THE INVENTION

It is an object of the present invention to provide a writing implement and fabricating method thereof which have overcome the problems residing in the prior art.

It is another object of the present invention to provide a writing implement which can supply a sufficient amount of liquid to be applied when a leading end thereof is turned downward and preventing a back flow of liquid rapidly and reliably when the leading end is turned upward.

It is further object of the present invention to provide a writing implement which has a simple construction, but is capable of preventing a ball valve member from moving out of a valve chamber and supplying a sufficient liquid flow.

It is further object of the present invention to provide a fabricating method which can easily produce a writing implement capable of supplying a sufficient liquid flow and holding a ball valve member in a valve chamber.

The invention is directed to a writing implement comprising valve means provided at a specified position along a liquid passage along which liquid to be applied flows. The valve means includes a valve member in the form of a ball, a chamber portion in which the ball valve member is placed, a sealing portion and a restricting portion provided respectively at bottom and leading ends of the chamber. The seal portion comes to contact with the ball valve member entirely along a circumference of the ball valve member to interrupt the flow of liquid. The restricting portion comes to contact with a circumferential portion of the ball valve member to restrict the movement of the ball valve member toward a leading end of the writing implement.

With this writing implement, when the tip thereof is turned downward, the ball valve member in the chamber portion falls toward the leading end of the chamber portion and come to rest on the restricting portion. Thus, the ball valve member is prevented from getting out of the chamber portion. In this state, the liquid to be applied is supplied to the tip of the writing implement sufficiently and reliably through clearances formed because of the difference in shape between the ball valve member and the chamber portion (i.e. a squarish cross-section of the ball valve member and a non-squarish cross-section of the chamber portion) and further through clearances between the restricting portion and the ball valve member. Specifically, when the cross-section of the chamber portion is substantially in the form of a right polygon, the clearances near the respective vertices serve as liquid passages.

On the contrary, when the tip of the writing implement is turned upward, the ball valve member in the chamber portion falls toward the bottom end of the chamber portion and comes to rest on the sealing portion. Since the chamber portion has a substantially right polygonal cross-section circumscribing the ball valve member, the movement of the ball valve member in the radial direction of the writing implement is restricted. Accordingly, the ball valve member reaches the sealing portion along the axial direction rapidly and is guided to the sealing portion reliably even if the writing implement is more or less inclined. In this state, the sealing portion and the ball valve member are sealably in contact with each other and the flow of liquid is interrupted at this portion, thereby preventing the liquid from flowing back from the leading side to the bottom side.

It is preferable that the cross-section of the chamber portion is substantially in the form of a right polygon circumscribing the ball valve member. Specifically, the cross-section of the chamber portion may be a right polygon or the one whose vertices are round. In this case, the restricting portion may advantageously include a plurality of projections which project inward from respective walls of the chamber portion and have inner end sides substantially parallel with the corresponding walls of the chamber portion.

In this writing implement, the cross-section of the space enclosed by the projections is substantially in the form of a right polygon. Thus, the liquid to be applied is allowed to flow reliably through clearances formed between the ball valve member and the boundary defined by the projections due to the difference in their shape.

In addition, the further axial movement of the ball valve member toward the leading end of the liquid applicator can be prevented reliably by the respective projections. A plurality of projections extending radially inward of the writing implement are particularly advantageous in terms of rigidity. They are also advantageous in that, even if one projection is damaged, the ball valve member is prevented from moving out of the chamber portion by the other projections.

The sealing portion has preferably a convex circumferential surface projecting inward of the writing implement. With such a convex circumferential surface, the sealing portion is allowed to be in contact with the ball valve member entirely along its circumference. Thus, the flow of the liquid to be applied is interrupted more reliably.

A method for fabricating the above-described writing implement consists preferably of the steps of adding inorganic matter to synthetic resin, and molding integrally a cylindrical body including the liquid passage, the chamber portion and the sealing portion using thus prepared synthetic resin. Thus, there can be obtained a liquid applicator having the cylindrical body integrally molded using the synthetic resin containing the inorganic matter.

According to this method, the contraction of the synthetic resin during the molding is suppressed because of the addition of the inorganic matter and the sealing portion is allowed to have high circularity. Therefore, the sealing portion and the ball valve member are satisfactorily in contact with each other along the circumference, thereby interrupting the flow of the liquid reliably (i.e., preventing a back flow of liquid).

When polypropylene is used as the synthetic resin and talc is used as the inorganic matter, it is preferable to add 1 to 10 weight percent of talc to polypropylene. By adding 1 or more weight percent of talc to polypropylene, the contraction of polypropylene during the molding can be sufficiently suppressed. An upper limit of an amount of talc to be added is set at 10 weight percent to ensure sufficient elasticity of the cylindrical body as a final product. Thus molded cylindrical body deforms elastically to make it easier to insert the ball valve member pressingly into the chamber thereof. The writing implement fabricated according to this method demonstrates a satisfactory sealing effect at the sealing portion and is free from plastic deformation of the cylindrical body resulting from the press-insertion of the ball valve member.

It is advantageous to add, before the step of inserting the ball valve member pressingly into the chamber from the inside of the restricting portion, a step of attaching water-insoluble lubricant (amide oleate, amide stearate or the like) which is in solid phase at normal temperature to the surface of the ball valve member. The ball valve member having the surface lubricated by, for example, amide oleate and amide stearate has a reduced resistance when being inserted into the chamber from the inside of the restricting portion, which in turn prevents the plastic deformation of the restricting portion and malfunction of the ball valve member. Thus, a writing implement provided with a back flow preventing valve and having a simple construction can be fabricated easily. In addition, since the lubricant is in solid phase at normal temperature and water-insoluble, it will not affect the liquid to be applied when the writing implement is used. Particularly, the use of amide oleate or amide stearate as lubricant brings about an excellent lubricating effect and prevents the lubricant from affecting adversely the liquid to be applied.

Preferably, the lubricant to be attached to the surface of the ball valve member is dissolved in solvent other than water to produce a solution. Thereafter, the solution is applied to the surface of the ball valve member, and dried. In this way, the water-insoluble lubricant can be deposited on the surface of the ball valve member easily and satisfactorily.

It will be appreciated that a "normal temperature" refers to a temperature at which writing implements are normally used, i.e., about less than 40° C. throughout this specification.

The above and other objects, features and advantages of the present invention will become more apparent upon a reading of the following detailed description and drawings.

DETAILED DESCRIPTION OF THE PREFERRED EMBODIMENTS OF THE INVENTION

Figure 7:
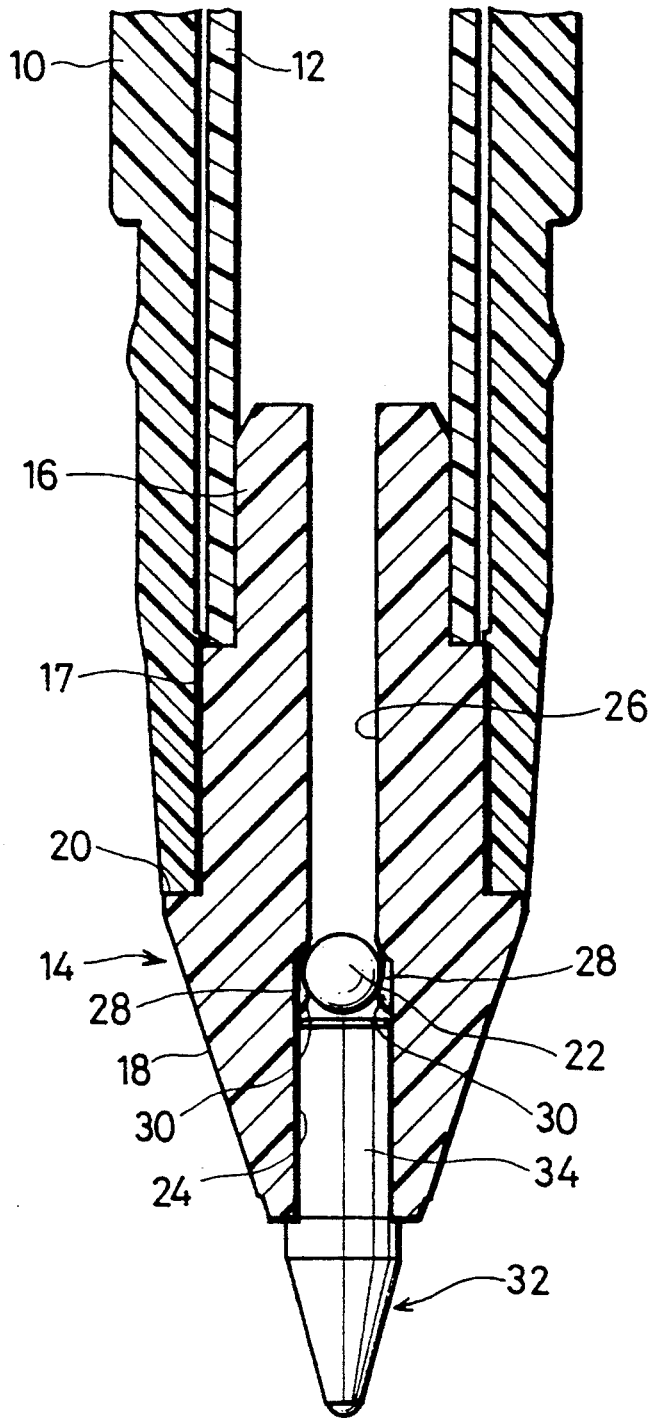
FIG. 7 is a vertical sectional diagram showing the writing implement when a nib is turned downward.
Figure 8:
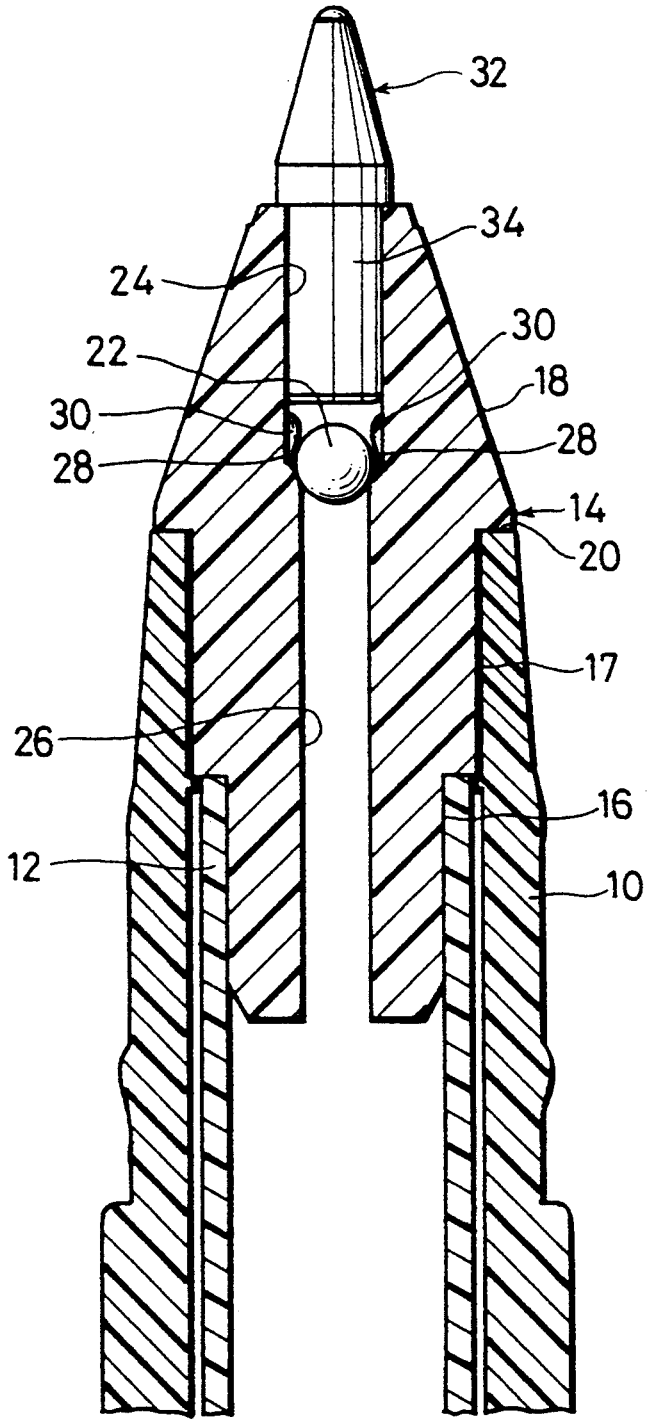
FIG. 8 is a vertical sectional diagram showing the writing implement when a nib is turned upward.

FIGS. 7, 8 show an essential portion of a writing implement as a first embodiment of the invention. It will be appreciated that, although a ball-point pen is described in this embodiment, the invention is applicable to a variety of writing implements which require the prevention of a back flow of liquid to be applied.

The illustrated ball-point pen includes an outer casing 10 and an inner casing 12. Ink (liquid to be applied) is contained in the inner casing 12. Bottom ends of these casings 10, 12 are sealed by unillustrated bottom caps and a hollow leading end portion (cylinder body) 14 is mounted on leading ends thereof. The portion 14 is made of elastically deformable material such as synthetic resin.

The outer circumferential surface of the leading end portion 14 is constituted by those of a hollow small cylinder portion 16, a hollow large cylinder portion 17 and a hollow conical portion 18 in this order from a bottom end side. The outer circumferential surface of the portion 18 is tapered. The small and large cylinder portions 16, 17 are fitted in lead end portions of the casings 12, 10 until a stepped portion between the large cylinder portion 17 and the conical portion 18 comes to contact with a leading end face of the casing 10.

Figure 1:
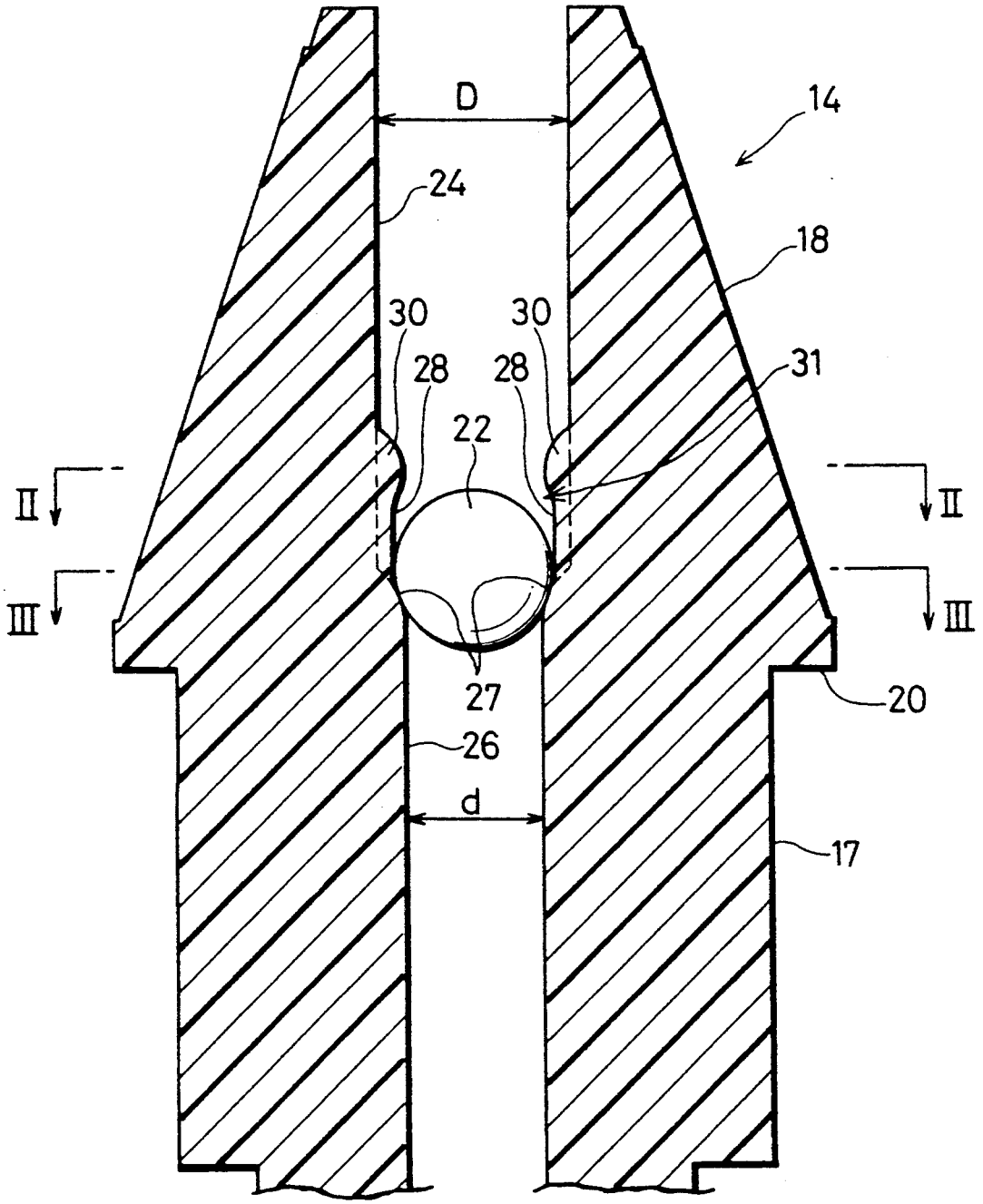
FIG. 1 is a vertical sectional diagram showing a leading end portion of a writing implement as an embodiment of the invention.

As shown also in FIG. 1, large and small bore portions 24, 26 are formed in this order from a leading end side. These bores extend continuously in an axial direction. A ball valve member 22 made of a steel ball is accommodated in the leading end portion 14. A diameter D of the large bore portion 24 is larger than a diameter of the ball valve member 22 and a diameter d of the small bore portion 26 is smaller than the diameter of the ball valve member 22.

Figure 3:
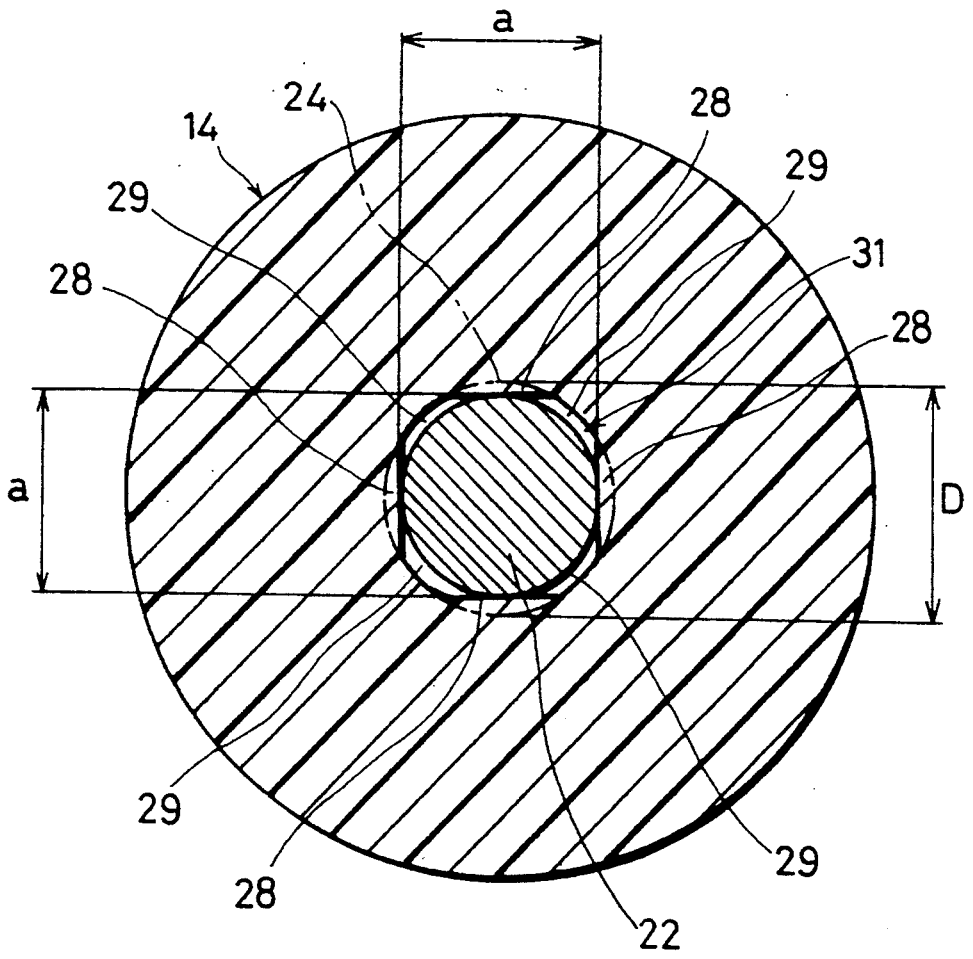
FIG. 3 is a sectional diagram taken along the line III—III in FIG. 1.
Figure 4:
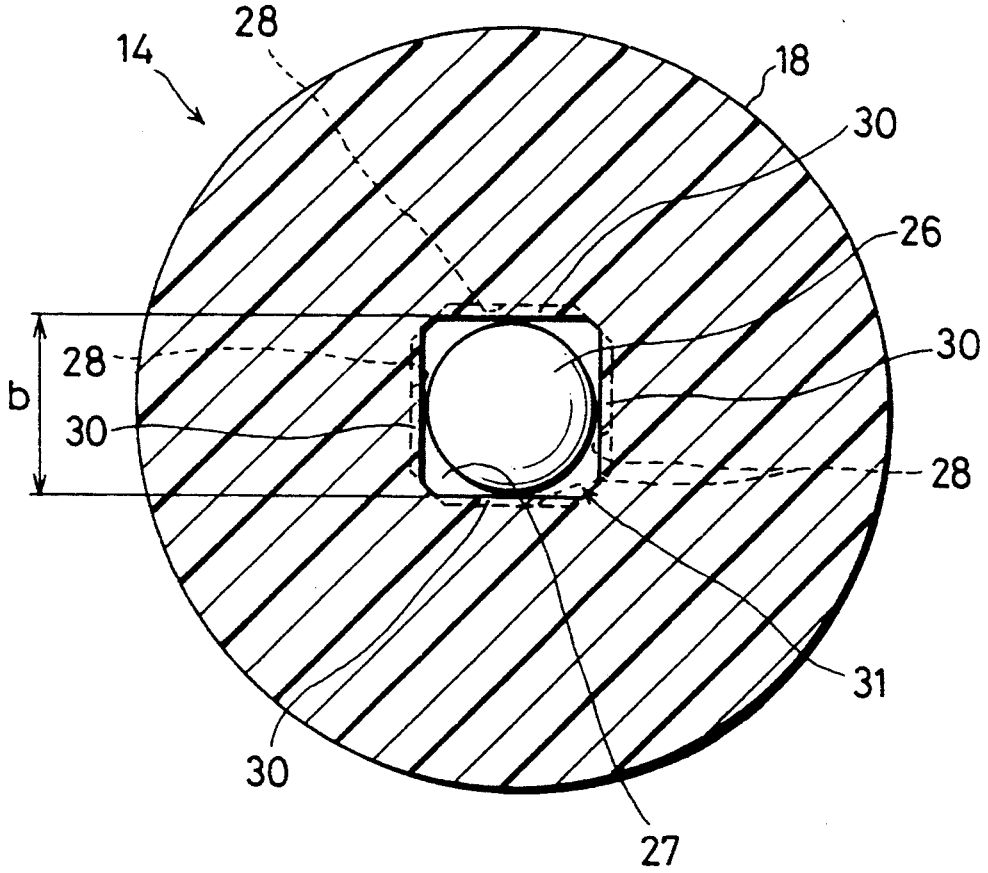
FIG. 4 is a horizontal sectional diagram showing a state where a ball valve member is removed in FIG. 2.
Figure 5:
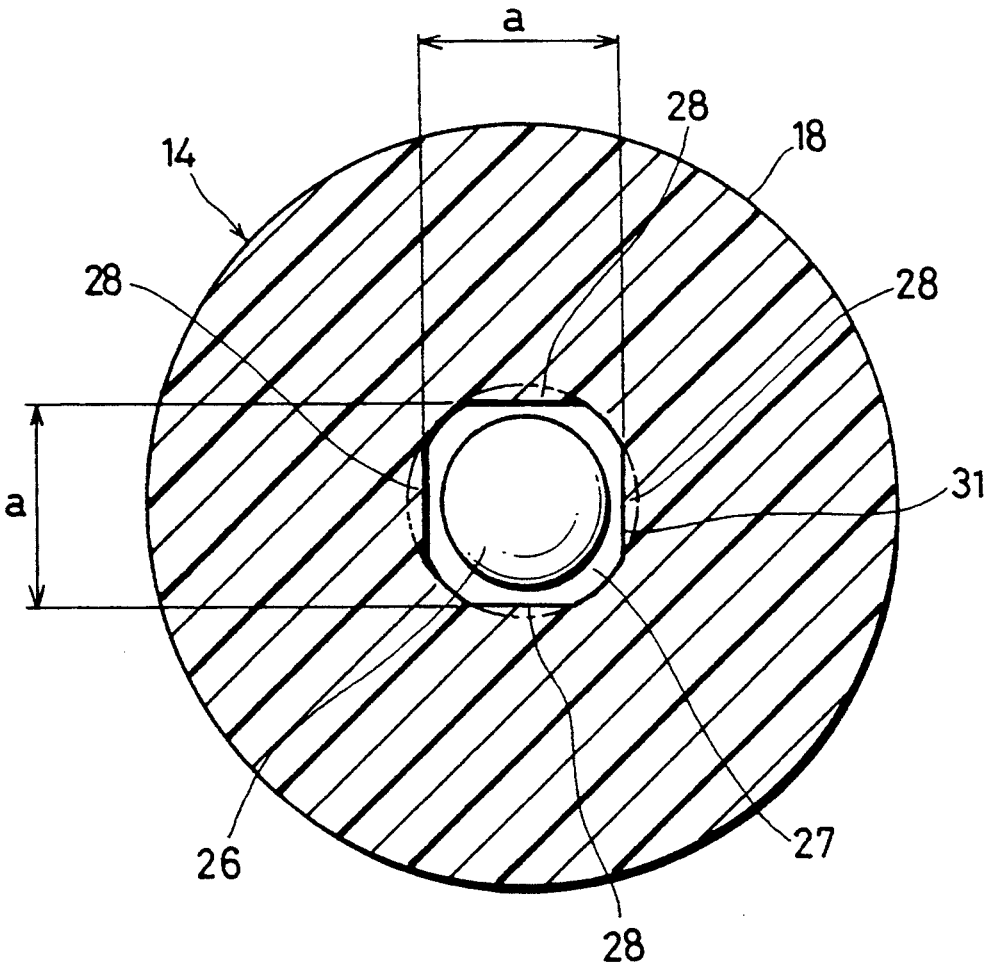
FIG. 5 is a horizontal sectional diagram showing a state where a ball valve member is removed in FIG. 3.

On a part of the large bore portion 24 neighboring the small bore portion 26 are formed four projected portions 28 spaced apart circumferentially. The surface of each projected portion 28 (i.e., the inner surface of the leading end portion 14) is made flat and an inner space of the portion 14 enclosed by these projected portions 28 forms a valve chamber 31 having a substantially squarish cross-section as shown in FIG. 3. The cross-section of this chamber 31 has such a squarish form circumscribing the ball valve member 22 and, more in detail, it is set such that four sides a are slightly larger than the diameter of the ball valve member 22 and four corners are arcuate.

Figure 2:
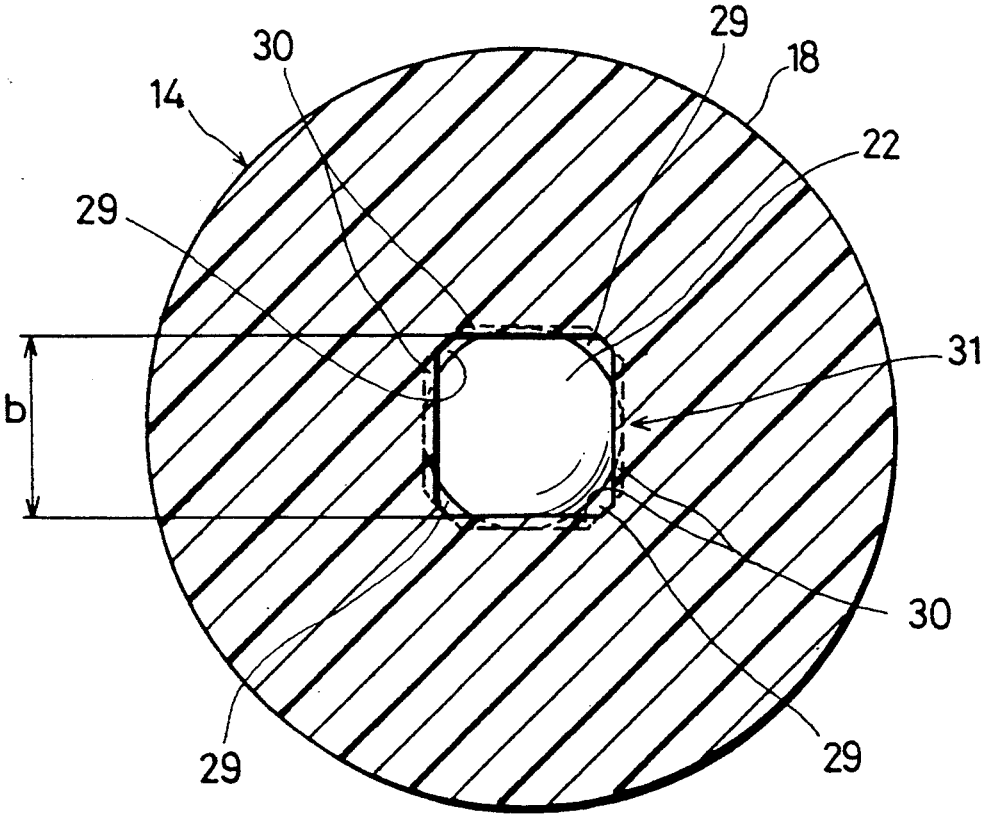
FIG. 2 is a sectional diagram taken along the line II—II in FIG. 1.

On a leading end portion of each projected portion 28 (an upper side portion in FIG. 1) is formed a projection (restricting portion) 30 projecting further inward from the projected portion 28. Each projection 30 has an inner end side in parallel with the inner face of the corresponding projected portion 28 (i.e., in parallel with the corresponding side of the squarish form as the horizontal cross-section of the valve chamber 31.) A side b of the squarish form defined by these projections 30, i.e., of a form shown in the middle of FIG. 2 is set smaller than the diameter of the ball valve member 22. Accordingly, these projections 30 prevents the ball valve member 22 from moving further toward the leading end.

Figure 6A:
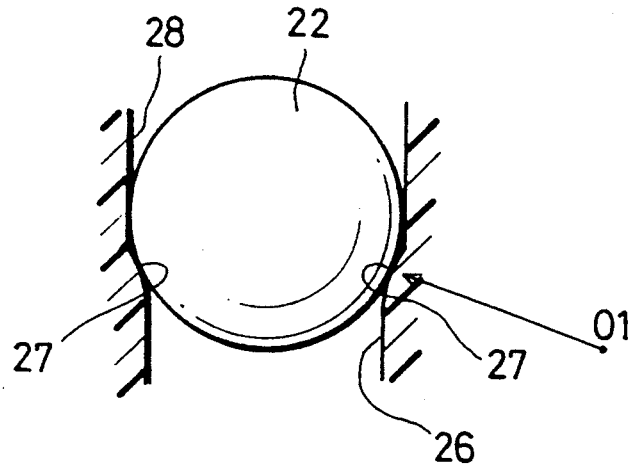
FIG. 6A is an enlarged sectional diagram showing a sealing portion of the leading end portion, the sealing portion having a convex surface.
Figure 6B:
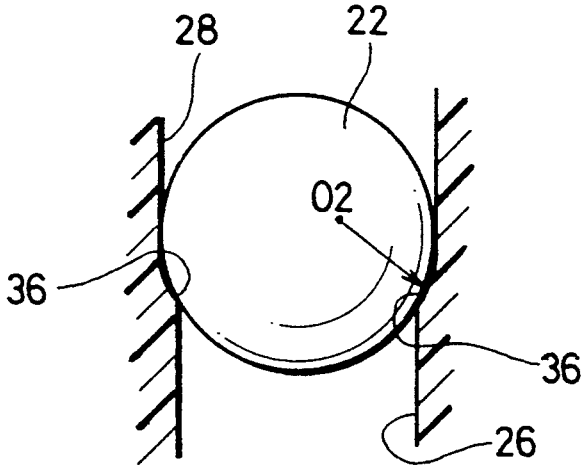
FIG. 6B is an enlarged sectional diagram showing a state where the sealing portion has a concave surface.

A stepped portion is formed at a boundary between the valve chamber 31 enclosed by the projected portions 28 and the ink passage formed by the small bore portion 26. This stepped portion serves as a sealing portion 27 having a convex spherical surface projecting inward of the leading end portion 14 over the entire circumference as shown in FIG. 6A (i.e., a center point 01 of a radius of curvature is located outside the portion 14). The ball valve member 22 is accommodated axially movably in the valve chamber 31 formed between the sealing portion 27 and the projections 30, and in contact with the sealing portion 27 entirely at a circumference (in the vertical cross-section, the ball valve member 22 is in contact with the sealing portion 27 at points). Thus, the ink flow is interrupted reliably at the sealing portion 27.

Indicated at 32 in FIGS. 7, 8 is a nib 32, and its bottom shaft 34 is fitted in the leading end of the large bore portion 24.

The action of this writing implement will be described next.

When a tip of the writing implement is turned downward as shown in FIG. 7, the ball valve member 22 in the valve chamber 31 falls toward the leading end of the writing implement and rests on the projections 30. In this state, clearances 29 are formed at four corners because the horizontal cross-section of the valve chamber 31 is substantially in the form of a right polygonal and that of the ball valve member 22 is a circle (see FIG. 3). The clearances 29 are formed at four corners also because of the difference in shape between a squarish space defined by the projections 30 and a circular horizontal cross-section of the ball valve member 22 (see FIG. 2). The ink is supplied reliably from the bottom side to the nib 32 through the clearances 29.

On the other hand, if the tip of the writing implement is turned upward, the ball valve member 22 in the valve chamber 31 falls toward the bottom end of the writing implement and rests on the sealing portion 27. The horizontal cross-section of the valve chamber 31 is substantially in the form of the right polygon circumscribing the ball valve member 22. Accordingly, the ball valve member 22 reaches the sealing portion 27 rapidly along the axial direction almost without making any radial movement (i.e., without making any unnecessary movement) and the ball valve member 22 rests on the sealing portion 27 reliably even if the writing implement is more or less inclined. Further, in this state, the ball valve member 22 is in contact with the sealing portion 27 entirely at the particular circumference thereof. Thus, the ink flow is interrupted reliably, thereby preventing the back flow of ink from the leading end to the bottom end.

As described above, in this writing implement, the horizontal cross-section of the valve chamber 31 accommodating the ball valve member 22 is a squarish form substantially circumscribing the ball valve member 22. The movement of the ball valve member 22 in the radial direction of the writing implement is restricted by four sides of this squarish form. Thus, the ball valve member 22 is guided axially reliably and rapidly without making any unnecessary movement and a sufficient amount of ink is allowed to flow reliably and easily through the clearances 29 at four corners.

Further in this embodiment, the sealing portion 27 formed at the bottom end of the valve chamber 31 is shaped so as to have a convex spherical surface projecting inward of the leading end portion 14 over the entire circumference as shown in FIG. 6A, i.e., the center point 01 of a radius of curvature of the spherical surface is located outside the portion 14. Spherical surfaces of the ball valve member 22 and the sealing portion 27 are in contact with each other entirely at a circumference. Compared with, for example, a case where a sealing portion 36 has a concave spherical surface (i.e., a center 02 of a radius of curvature is located inside the leading end portion 14 (see Japanese Examined Utility Model Publication No. 4-52067)), the sealing portion 27 is more reliably in contact with the ball valve member 22 (high sealability) and is thereby capable of preventing the back flow of ink more reliably.

Furthermore, in this embodiment, the projections 30 are formed projectingly from all the inner end faces of the corresponding projected portions 28, and inner end sides thereof are made substantially parallel with the inner end faces of the projected portions 28 so that the space enclosed by these projections 30 also takes in a squarish form. Accordingly, each clearance 29 is allowed to have sufficient space between this squarish form and the outline (circle) of the ball valve member 22, thereby allowing the ink to flow sufficiently, and the ball valve member 22 is prevented reliably from moving out of the valve chamber 31 by the projections 30.

A mechanism for restricting the movement of the ball valve member 22 may not be the projections 30 as described above. Any simple projection will do, provided that it can restrict the movement of the ball valve member 22 toward the leading end of the writing implement. However, a plurality of projections 30 extending radially inward of the writing implement as in the foregoing embodiment are advantageous in terms of rigidity. They are also advantageous in that, even if one projection 30 is damaged, the ball valve member 22 is prevented from moving out of the valve chamber 31 by the other projections 30.

In this invention, it is sufficient that the horizontal cross-section of the valve chamber 31 takes in any non-circular form substantially circumscribing the ball valve member 22. It may take in a triangular form, a polygonal form having five or more sides (particularly preferably a right polygonal form), or an elliptical form.

There will be next described a method for fabricating the aforementioned writing implement.

1) The leading end portion 14 is molded integrally into the above specified form using elastically deformable synthetic resin such as polypropylene.

2) Lubricant is deposited on the surface of the ball valve member 22. The lubricant used here is in solid phase at normal temperature and insolvable in water, such as amide oleate and amide stearate to be described later. A lubricant depositing method may be: the lubricant is dissolved in any solvent other than water (e.g., alcohol solvent); thus obtained solution is applied to the surface of the ball valve member 22 and is dried.

3) The ball valve member 22 is inserted into the leading end portion 14 through the large bore portion 24 and is further inserted pressingly into the valve chamber 31 located more to the bottom than the projections 30 while causing the projections 30 to deform elastically radially outward. As a result, the ball valve member 22 is confined in the valve chamber 31.

4) All the parts including the leading end portion 14 are assembled into a complete writing implement.

As described above, this method is capable of simplifying the structure of the writing implement compared to the one, for example, according to which a plurality of parts are assembled into a valve chamber, because the leading end portion 14 including the valve chamber 31 is molded integrally using synthetic resin. Further, the lubricant is deposited on the surface of the ball valve member 22 before the ball valve member 22 is inserted into the integrally molded leading end portion 14. This reduces the resistance which acts when the ball valve member 22 is inserted pressingly, thereby improving the operability in fabricating the writing implement. The reduction in the resistance leads to the prevention of the plastic deformation of the projections 30 when the ball valve member 22 is inserted pressingly, which further prevents the malfunction of the ball valve member 22 as a valve chamber 31 resulting from the deformation.

Moreover, since the lubricant in use is in solid phase at normal temperature and insoluble in water, it will not affect adversely the liquid to be applied when the writing implement is used. In other words, a variety of conventionally used liquids to be applied (e.g., watercolor ink) can be used without any problem.

EXPERIMENTAL DATA

TABLE-1 below shows results of tests conducted to see how apt lubricants including fatty acid ester, fatty acid amide and mineral oils are as lubricant used in the invention. In this table, a column "Eating-in of the Ball Valve" shows the number of cases where the ball valve member 22 eats in the projections 30 when the assembled writing implement is tested in a centrifugal separator.

TABLE 1

| (1) | (2) | (3) | (4) | (5) | (6) |
|---|---|---|---|---|---|
| 1 | Rasjet (fatty acid ester) | 0.015 | ○ | X | 5/300 |
| 2 | NBS (n-butylstearic acid) | 0.100 | Δ | X | |
| 3 | NBS (n-butylstearic acid) | 0.250 | Δ | X | |
| 4 | NBS (n-butylstearic acid) | 0.500 | Δ | X | |
| 5 | Amide Oleate | 0.050 | Δ | ○ | |
| 6 | Amide Oleate | 0.100 | ○ | ○ | 0/300 |
| 7 | Amide Oleate | 0.250 | ○ | ○ | 0/300 |
| 8 | Amide Oleate | 0.500 | ○ | ○ | 0/300 |
| 9 | Amide Stearate | 0.050 | ○ | ○ | |
| 10 | Amide Stearate | 0.100 | ○ | ○ | |
| 11 | Amide Stearate | 0.250 | ○ | ○ | |
| 12 | Amide Stearate | 0.500 | ○ | ○ | |
| 13 | Liquid paraffin | 0.015 | ○ | X | |
| 14 | Turblne Oil | Much | X | X | |
| 15 | Silicon Oil | Much | X | ○ | |

(1) Sample No.;
(2) Sample Name;
(3) Applying Amount g/1000 Ball Valves;
(4) Ink Repellency {○: repel, Δ: little repel, X: not repel}
(5) Stickiness {X: sticky, ○: not sticky}
(6) Eating-in of Ball Valve The sample name "Rasjet" mentioned in Sample No. 1 is the trademark for the compound produced by Nippon Kouzai Kabushiki Kaisha, a Japanese company.

From this table, it is understood that particularly amide oleate and amide stearate are suitable as lubricant used in the invention, since they are excellent in the ink repellency and the stickiness preventiveness and capable of preventing from the ball valve member from eating in the projections 30.

Further, it is preferable to add inorganic matter such as talc to synthetic resin such as polypropylene and to mold the leading end portion 14 integrally using thus prepared synthetic resin. By the addition of the inorganic matter, the contraction of the synthetic resin during the molding can be suppressed effectively, enabling the sealing portion 27 to have high circularity. Thus, the sealing portion 27 and the ball valve member 22 come to contact entirely along a circumference and the back flow of ink can be prevented reliably even in a state where the tip of the writing implement is turned upward.

EXPERIMENTAL DATA

Table-2 shows results of tests on a preferable amount of talc to be added when polypropylene is used as the above synthetic resin and talc is used as the above inorganic matter. In this table, the qualities of "circularity of sealing portion" and "form of projection" are determined by observing the sealing portion 27 and the projections 30 in the foregoing embodiment using a microscope. The form of the projections 30 is checked after the leading end portion 14 is molded and the ball valve member 22 is inserted pressingly into the valve chamber 31 through the projections 30.

TABLE 2

| SAMPLE NO. | TALC CONTENT WEIGHT % | CIRCULARITY OF SEALING PORTION | FORM OF PROJECTIONS |
|---|---|---|---|
| 1 | 0 | X | ○ |
| 2 | 1 | ○ | ○ |
| 3 | 3 | ○ | ○ |
| 4 | 5 | ○ | ○ |
| 5 | 8 | ○ | ○ |
| 6 | 10 | ○ | ○ |
| 7 | 12 | ○ | X |

As is clear from this table, the sealing portion 27 is allowed to have a sufficient circularity by adding 1 or more weight percent of talc to polypropylene. The reason for this can be considered that talc serves to suppress effectively the contraction of the polypropylene during the molding. However, when 12 or more weight percent of talc is added, the projections 30 deform. The reason for this can be considered as follows. An excessive addition of talc damages the elasticity of the leading end portion 14. When the ball valve member 22 is inserted forcibly into the valve chamber 31 while expanding the projections 30 radially outward, this causes the plastic deformation in the projections 30. Accordingly, it is very preferable to add 1 to 10 weight percent of talc to polypropylene.

When another inorganic matter is added to another synthetic resin, it is appropriate to search a preferable amount of inorganic matter to be added in each case and to mold the leading end portion 14 integrally from the synthetic resin including such an amount of inorganic matter.

What is claimed is:

1. A writing implement comprising:

valve means provided at a specified position along a liquid passage along which liquid to be applied flows, the valve means including:

a valve member in the form of a ball;

a chamber portion in which the ball valve member is placed, the chamber portion having a cross-section in the form of a non-circular substantially circumscribing the ball valve member;

a sealing portion defined on a bottom end of the chamber portion, the seal portion being operable to come to contact with the ball valve member entirely along a circumference of the ball valve member to interrupt the flow of liquid; and a restricting portion defined on a leading end of the chamber portion, the restricting portion being operable to come to contact with a circumferential portion of the ball valve member to restrict the movement of the ball valve member toward a leading end of the writing implement.

2. A writing implement as defined in claim 1 wherein the cross-section of the chamber portion is substantially in the form of a right polygon circumscribing the ball valve member.

3. A writing implement as defined in claim 2 wherein the restricting portion includes a projection projecting inward and an inner end side of the projection is parallel with the wall of the chamber portion.

4. A writing implement as defined in claim 1 wherein the sealing portion has a convex circumferential surface projecting inward of the writing implement.

5. A writing implement as defined in claim 1 wherein the chamber portion and the sealing portion are defined integrally with the liquid passage by a cylindrical body, the cylindrical body being made of synthetic resin added with inorganic matter.

6. A writing implement as defined in claim 5 wherein the cylindrical body is made of polypropylene added with 1 to 10 weight percent of talc.

7. A method for fabricating a writing implement comprising a cylindrical body for defining a liquid passage along which liquid to be applied flows, the liquid passage having:

a chamber portion for holding a ball valve member loosely: and a sealing portion being operable to come to contact with the ball valve member entirely along a circumference of the ball valve member to interrupt the flow of liquid;

the method comprising the steps of:

adding inorganic matter to synthetic resin; and molding the synthetic resin into the cylindrical body.

8. A fabricating method defined in claim 7 wherein:

the synthetic resin is polypropylene: and the inorganic matter is 1 to 10 weight percent of talc.

9. A method for fabricating a writing implement comprising:

a liquid passage along which liquid to be applied flows;

valve means provided at a specified position of the liquid passage, the valve means including:

a valve member in the form of a ball;

a chamber portion in which the ball valve member is placed loosely; and a sealing portion being operable to come to contact with the ball valve member entirely along a circumference of the ball valve member to interrupt the flow of liquid; and a restricting portion being operable to come to contact with a circumferential portion of the ball valve member to restrict the movement of the ball valve member toward a leading end of the writing implement;

the method comprising the steps of:

forming a cylindrical body defining the liquid passage, the chamber portion, the sealing portion, and the restricting portion using elastically deformable material;

attaching water-insoluble lubricant to a surface of the ball valve member, the water-insoluble lubricant being in solid phase at normal temperature; and inserting the ball valve member pressingly into the chamber portion through the restricting portion.

10. A fabricating method as defined in claim 9 wherein the water-insoluble lubricant attachment step includes the steps of:

dissolving the lubricant into solvent other than water to produce a solution;

applying the solution to the surface of the ball valve member; and drying the ball valve member.

11. A fabricating method as defined in claim 9 wherein the lubricant is one of either amide oleate or amide stearate.

* * * * *